US006631533B2

(12) United States Patent
Stahle et al.

(10) Patent No.: US 6,631,533 B2
(45) Date of Patent: Oct. 14, 2003

(54) SWIMMING POOL CLEANER COMPONENT

(75) Inventors: Manfred Stahle, Sandton (ZA); Dieter H F Kallenbach, Sandton (ZA)

(73) Assignee: Corrupipe CC (ZA)

( * ) Notice: Subject to any disclaimer, the term of this patent is extended or adjusted under 35 U.S.C. 154(b) by 118 days.

(21) Appl. No.: 09/935,707

(22) Filed: Aug. 24, 2001

(65) Prior Publication Data

US 2003/0037396 A1 Feb. 27, 2003

(51) Int. Cl.[7] ..... E04H 4/16
(52) U.S. Cl. ..... 15/246; 15/1.7
(58) Field of Search ..... 15/1.7, 180, 201, 15/230, 230.1, 246, 385, 415.1, 420

(56) References Cited

U.S. PATENT DOCUMENTS

| | | | | | |
|---|---|---|---|---|---|
| 3,605,171 | A | * | 9/1971 | Candor et al. | 15/420 X |
| 4,193,156 | A | * | 3/1980 | Chauvier | 15/1.7 |
| 5,418,995 | A | * | 5/1995 | Rice et al. | 15/1.7 |
| 5,433,985 | A | * | 7/1995 | Atkins | 15/1.7 X |
| 6,122,794 | A | * | 9/2000 | Atkins | 15/246 |
| 6,125,492 | A | * | 10/2000 | Prowse | 15/1.7 |
| 6,463,614 | B1 | * | 10/2002 | Supra | 15/1.7 |

* cited by examiner

*Primary Examiner*—Mark Spisich
(74) *Attorney, Agent, or Firm*—Banner & Witcoff, Ltd.

(57) ABSTRACT

The invention concerns a surface contacting disc for location around the inlet of a suction operated pool cleaner wherein at least one concentric groove is provided in the surface engaging face of the disc which provides flexibility for the outer part of the disc to fold progressively along the grooves.

5 Claims, 1 Drawing Sheet

SWIMMING POOL CLEANER COMPONENT

FIELD OF THE INVENTION

This invention relates to a swimming pool cleaner component and more particularly to the surface engaging disc of certain vacuum operated automatic pool cleaners.

BACKGROUND TO THE INVENTION

Several different models of automatic pool cleaners have been developed which operate on the suction generated by the pool filtration plant. The inlet to the plant is connected through the swimming pool cleaner and a flexible pipe. The cleaner includes a mechanism which intermittently interrupts the flow through the pipe and results in the cleaner being moved stepwise over the surface being cleaned.

This type of cleaner generally requires an annular disc of flexible material around the inlet to the body of the cleaner to assist in holding the cleaner on the surface being cleaned.

The discs generally available are moulded from suitable wear resistant plastics material and are well known. Various minor modifications have been made to these basic annular discs, including variations in the compositions from which they are made, in efforts to improve their effectiveness in operation. Some of these modifications including scalloping of the edge of the disc and a peripheral series of inwardly directed ribs of different configurations to prevent the disc holding up against obstacles in the pool. Also series of holes have been made through the disc to allow water and entrained debris to pass through the disc to the inlet to the cleaner. Ribs and/or channels extending radially from either the central opening through the disc or from the edge of the disc have been provided in an effort to control the flexibility of the discs.

However the flexibility obtained has been mainly across the disc more or less along radial lines.

OBJECT OF THE INVENTION

It is an object of this invention to provide a disc of the kind referred to in which flexibility is imparted in a manner which facilitates the pool cleaner negotiating obstacles protruding from the surface being cleaned.

SUMMARY OF THE INVENTION

In accordance with this invention there is provided a disc for a pool cleaner of the kind referred to in which at least one groove is provided in the undersurface of the disc substantially concentric with the disc periphery.

Further features of the invention provide for there to be a series of radially spaced grooves, for the series to be interconnected by radial grooves symmetrically spaced around the disc and for the radial grooves to extend beyond the inner concentric groove.

The invention also provides for there to be holes through the disc intersecting the inner ends of at least some of the radial grooves and at least some of the intersections of the radial and concentric grooves.

BRIEF DESCRIPTION OF THE DRAWINGS

These and other features of this invention will become apparent from the following description of one example described below with reference to the accompanying drawings in which.

DETAILED DESCRIPTION OF THE INVENTION

Figure 1:
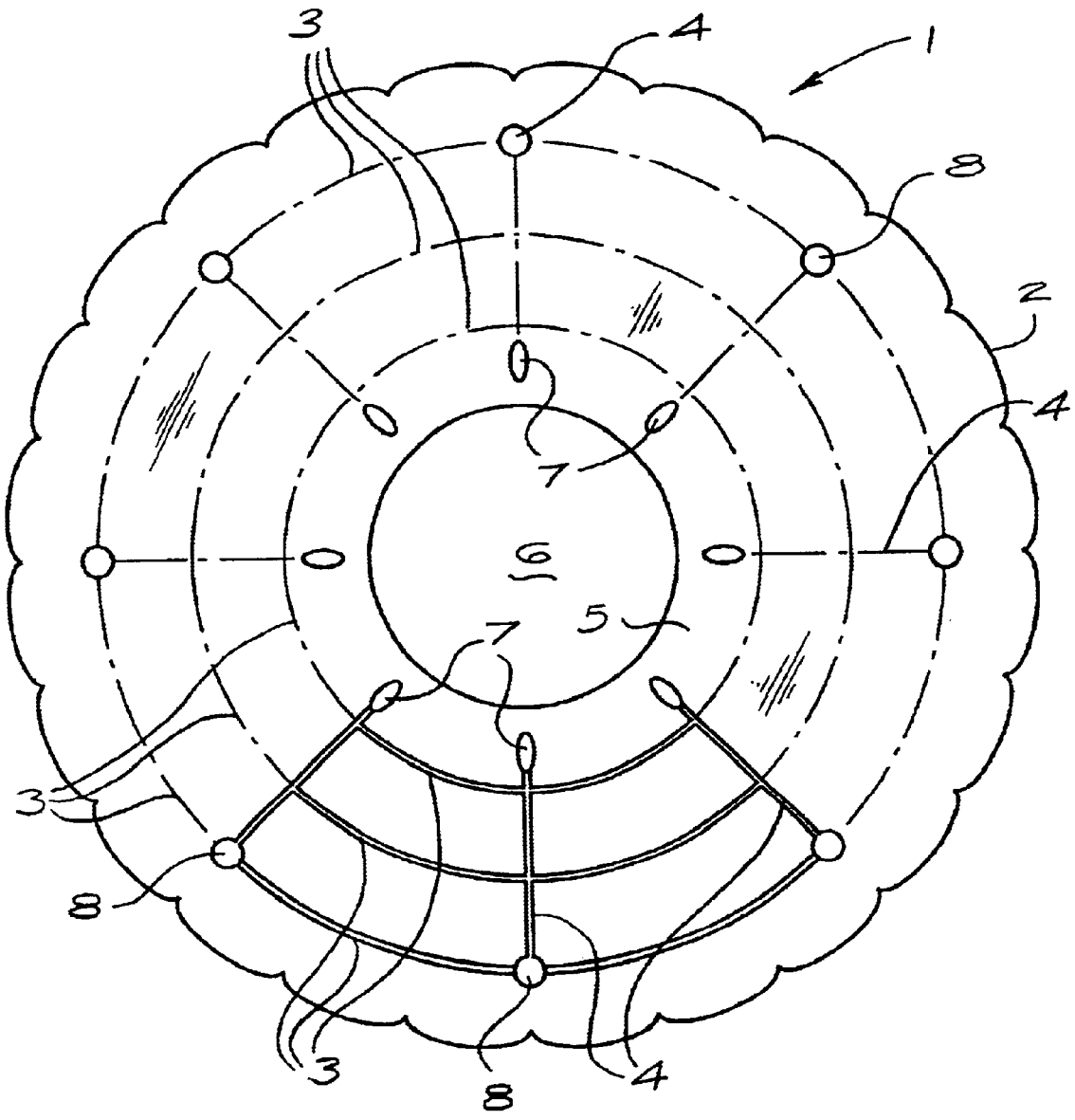
FIG. 1 is the underside of a swimming pool cleaner disc.

The disc (1) illustrated is moulded from suitable plastics material, usually polyurethane.

The disc (1) is generally of the size of the discs referred to earlier in this specification and may have 400 mm and 105 mm outer and inner diameter respectively.

The outer edge (2) of the disc (1) is scalloped as shown and the edge rounded.

The side of the disc which is not shown in the drawing is that which in use is remote from the surface being cleaned. A series of upwardly projecting fins extending a short distance towards the centre of the disc and equally spaced around the periphery will preferably be provided on the disc.

Grooves (3) which may be made approximately 10 mm wide and 2.5 mm deep, are spaced apart radial from the edge and from each other at a distance of about 30 mm. These grooves (3) may be of different cross sectional shape provided only they give the flexibility referred to below.

The grooves (3) provide flexibility which permit the outer part of the disc (1) which contacts an obstruction in the movement of the pool cleaner in use to fold progressively along the grooves (3). This further enables the remainder of the disc (1) to remain in operative contact with the surface being cleaned. Thus the disc (1) flexes easily while retaining a large surface area in contact with the pool surface.

A symmetrical series of similarly sized grooves (4) are equidistantly spaced apart and extend radially between the outermost of grooves (3) into the space (5) between the central hole (6) in the disc and the innermost circular grooves (3).

Holes (7) are made through the disc (1) at the inner ends of the radial grooves (4).

Also holes (8) are made through the intersection of the radial grooves (4) and the outermost groove (3). The holes (7) can be of larger size than holes (8) and may be of oblong or other non-circular shape.

The sizes of the grooves and holes through the disc at the ends or intersection of the grooves may be varied to give different characteristics to the effect of the disc in use. Further the preferred material of the disc will be a highly wear resistant polyurethane composition which may also be varied to meet particular requirements.

Convenient sizes for the circular holes illustrated may be 10 mm and the oblong holes may be 10 mm wide and 15 mm deep.

In use the disc has been found to operate satisfactorily over a wide range of flow rates to the filter plant and the grooves and holes provide both added flexibility and facilitate the passage of dirt on the surface being cleaned from that surface through the disc and into the body of the cleaner.

The arrangement of the grooves and holes maintains a substantially even suction over the whole of the undersurface of the disc and this assists materially in retaining the disc against the surface being cleaned.

What is claimed is:

1. A disc for a pool cleaner in which a series of radially spaced grooves concentric with the disc periphery is provided in the under surface of the disc and interconnected by radial grooves symmetrically spaced around the disc, which radial grooves extend beyond the innermost concentric grooves and terminate in holes extending through the disc.

2. A disc as claimed in claim 1 in which the edge of the disc is rounded and has a scalloped periphery.

3. A disc for a cool cleaner in which a series of radially spaced grooves concentric with the disc periphery is provided in the under surface of the disc and interconnected by radial grooves symmetrically spaced around the disc, in which there are holes through the disc at at least some of the intersections between the concentric and radial grooves.

4. A disc as claimed in claim 3, wherein the radial grooves extend beyond the innermost concentric grooves.

5. A disc for a pool cleaner in which a series of radially spaced grooves concentric with the disc periphery is provided in the undersurface of the disc and interconnected by radial grooves symmetrically spaced around the disc, holes through the disc at least some of the intersections between the concentric and radial grooves and the ends of the radial grooves nearest the centre of the disc.

* * * * *